US007695880B2

(12) United States Patent
Yoshimura

(10) Patent No.: US 7,695,880 B2
(45) Date of Patent: Apr. 13, 2010

(54) TONER, ELECTROPHOTOGRAPHIC APPARATUS AND PROCESS CARTRIDGE

(75) Inventor: Kimihiro Yoshimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 429 days.

(21) Appl. No.: 11/754,659

(22) Filed: May 29, 2007

(65) Prior Publication Data

US 2007/0281232 A1 Dec. 6, 2007

(30) Foreign Application Priority Data

May 31, 2006 (JP) ..... 2006-151777

(51) Int. Cl.
*G03G 9/08* (2006.01)

(52) U.S. Cl. ..... 430/108.2; 430/108.24; 430/108.6; 430/108.7; 399/252

(58) Field of Classification Search ..... None
See application file for complete search history.

(56) References Cited

U.S. PATENT DOCUMENTS

| | | | | |
|---|---|---|---|---|
| 5,665,511 | A * | 9/1997 | Imai et al. | 430/108.24 |
| 6,122,473 | A * | 9/2000 | Goseki et al. | 399/286 |
| 2004/0023139 | A1 | 2/2004 | Yoshimura et al. | 430/59.6 |

FOREIGN PATENT DOCUMENTS

| | | |
|---|---|---|
| JP | 36-010231 | 7/1961 |
| JP | 56-013945 | 4/1981 |
| JP | 59-053856 | 3/1984 |
| JP | 59-061842 | 4/1984 |
| JP | 2003-091223 | 3/2003 |
| JP | 2005-338586 | 12/2005 |
| JP | 2007-079144 | 3/2007 |
| WO | WO 02/073320 A1 | 9/2002 |

OTHER PUBLICATIONS

Japanese Patent Office machine-assisted translation of JP 2007-079144 (pub. Mar. 2007).*

Bagshaw et al., "Templating of Mesoporous Molecular Sieves by Nonionic Polyethylene Oxide Surfactants", Science, 269, 5228, 1242-1244, Sep. 1, 1995.

Bagshaw et al., "Mesoporous Alumina Molecular Sieves", Angew. Chem. Int. Ed. Engl., 35, 10, 1102-1105, 1996.

Barrett et al., "The Determination of Pore Volume and Area Distributions in Porous Substances. I. Computations from Nitrogen Isotherms", J. Amer. Chem. Soc., 73, 373-380, 1951.

Brunauer et al., "Adsorption of Gases in Multimolecular Layers", J. Amer. Chem. Soc., 60, 309-319, 1938.

Burnside et al., "Nanocrystalline Mesoporous Strontium Titanate as Photoelectrode Material for Photosensitized Solar Devices: Increasing Photovoltage through Flatband Potential Engineering", J. Phys. Chem. B, 103, 43, 9328-9332, 1999.

Ho et al., "Morphology-Controllable Synthesis of Mesoporous $CeO_2$ Nano- and Microstructures", Chem. Mater., 17, 4514-4522, 2005.

Vaudry et al., "Synthesis of Pure Alumina Mesoporous Materials", Chem. Mater., 8, 1451-1464, 1996.

Wakayama et al., "Nanoporous Metal Oxides Synthesized by the Nanoscale Casting Process Using Supercritical Fluids", Chem. Mater., 13, 2392-2396, 2001.

Zou et al., "Synthesis and Characterization of Nanosized Ceria Powdeers and High-Concentration Ceria Sols", Ind. Chem. Res., 43, 3019-3025, 2004.

Translation of Office Action dated Dec. 5, 2008 for CN 2007-101054367.

* cited by examiner

*Primary Examiner*—Janis L Dote
(74) *Attorney, Agent, or Firm*—Fitzpatrick, Cella, Harper & Scinto

(57) ABSTRACT

A toner, and an electrophotographic apparatus and an electrophotographic process cartridge using the toner are provided having excellent charge stability without adversely affecting electric properties of the toner even when used for a long period of time and having excellent image density stability without bringing about image deletion and blurring. The toner includes colored particles containing at least a binder resin and a colorant, and two or more external additives. At least one of the external additives includes hydrophobic treated mesoporous particles, and the mesoporous particles are inorganic particles of at least one type selected from the group consisting of silica, titanium oxide, alumina, cerium oxide, and strontium titanate.

5 Claims, 1 Drawing Sheet

TONER, ELECTROPHOTOGRAPHIC APPARATUS AND PROCESS CARTRIDGE

BACKGROUND OF THE INVENTION

1. Field of the Invention

The present invention relates to a toner for developing a latent electrostatic image for use in an electrostatic copier, a laser printer or the like. The present invention also relates to an electrostatic photographic apparatus and a process cartridge using the toner. More particularly, the present invention relates to a toner containing hydrophobic treated mesoporous particles as an external additive as well as an electrophotographic apparatus and a process cartridge using the toner.

2. Related Background Art

In an image forming method used in an electrophotographic apparatus and an electrostatic recording apparatus, various methods are known for forming a latent image on an electrophotographic photosensitive member (hereinafter referred to also as a "photosensitive member") and a photosensitive member such as electrostatic recording dielectric material. For example, an electrophotographic method is generally performed as follows. That is, a photosensitive member with photoconductive layers is uniformly charged so as to have a desired polarity and potential and then subjected to image pattern exposure to form an electric latent image. The latent image is developed with a toner to be visualized, and the toner image is transferred and fixed onto a transfer medium such as paper. Recent copiers, facsimile machines, printers, or electrophotographic image-forming apparatus provided with at least two functions of these have higher resolution than ever as high as, for example, 600 or 1200 dpi. Along with this, a developing method for higher resolution and higher definition is demanded.

The electrophotographic image-forming apparatus is known to generate various discharge induced products such as NOx, SOx, and ozone due to charging energy when the photosensitive member is charged. The discharge induced products adhere onto the photosensitive member to deteriorate lubricity of the surface of the photosensitive member. With an increased amount of the discharge product on the surface of the photosensitive member, the discharge induced products absorb more moisture in the air at high humidities to decrease surface electric resistance of the electrophotographic photosensitive member. Thereby, it becomes difficult to retain an electrostatic latent image on the photosensitive member, thus generating image defects such as blurring and deletion in output toner images.

If an electrophotographic image forming apparatus may be constructed so that a member coming in contact with the surface of an electrophotographic photosensitive member, for example, a cleaning member scrapes off a relatively large amount of the surface of the photosensitive member along with the discharge induced products, image defects can be prevented from occurring. However, this construction results in such a drawback that the service life of the photosensitive member is decreased.

In this case, if the photosensitive member is highly durable, the surface of the photosensitive member tends to be hardly refreshed. Even if the surface of the photosensitive member (a drum) is scraped off, no lubricating action by generated powder is expectable. However, in the case of an organic material electrostatic carrier having a lower strength than an inorganic material electrophotographic photosensitive member, electrophotographic photosensitive members having decreased surface abrasion and an increased service life has been developed through recent progress of electrophotographic photosensitive member technology. Thus, it is desirable that the accumulation of discharge induced products due to a decrease in surface abrasion should be avoided.

Accordingly, various constructions have been proposed for removing discharge induced products adhering on the surface of an electrophotographic photosensitive member while suppressing a reduction in service life of the electrophotographic photosensitive member. For example, a discharge product removing device has been proposed including a water applying unit that applies water onto the surface of the electrophotographic photosensitive member and a water removing unit that removes water from the surface of the electrophotographic photosensitive member. The discharge product removing device utilizes such a property that the discharge induced products produced on the surface of the electrophotographic photosensitive member dissolves in water, and has such an advantage that the discharge induced products can be removed relatively effectively.

However, in general, the surface of an electrophotographic photosensitive member is hydrophobic, hence when water is applied onto the surface of the electrophotographic photosensitive member, water is formed into droplets due to water repellency of the surface of the electrophotographic photosensitive member and the droplets are scattered thereon. Therefore, even if the discharge induced products are dissolved in water applied onto the surface of the electrophotographic photosensitive member, the aqueous solution containing the discharge induced products in the form of droplets adheres on the surface of the electrophotographic photosensitive member in a thinly scattered state. Since the droplets are thinly scattered on the surface of the electrophotographic photosensitive member, when wiped off, the effect of removing discharge induced products is different between portions of the surface of the electrophotographic photosensitive member where droplets are adhered and portions of the surface of the electrophotographic photosensitive member where no droplets are present, so the properties of the surface of the electrophotographic photosensitive member after the wiping may be non-uniform.

If the image forming apparatus is constructed so that the discharge induced products on the electrophotographic photosensitive member can be removed, the discharge induced products can not be sufficiently removed if the adhesion amount of the discharge induced products on the surface of the electrophotographic photosensitive member becomes large, thus it may be difficult for image defects to be reliably prevented.

Further, there has been proposed a method of supplying a compound that has an acid-receiving effect, such as hydrotalcite, to an electrophotographic photosensitive member. According to this proposal, the hydrotalcite compound is a lamellar compound that has a positively charged $[Mg^{++}_{2(1-x)}Al^{+++}_{2x}(OH^{-1})_4]$ layer and a negatively charged $[CO_3^{--}{}_x \cdot mH_2O]$ layer. The $CO_3^{--}$ in the structure is ion-exchangeable and is easily replaced by another anion to adsorb acids. This action decreases the influence of the discharge induced products. However, a toner containing such an ionic compound may adversely affect electric properties of the toner, for example, before and after absorbing moisture. Further, it has been proposed that zeolite is used as a polar adsorbent composed of inorganic particles (Japanese Patent Application Laid-Open No. 2003-091223). However, in general, zeolite crystals contain cations exchangeable for water molecules in a large cavity composed of a condensed anion having a three-dimensional skeleton structure of alminosilicate. Therefore, zeolite is an ionic compound similar to the above-mentioned hydrotalcite, and may have similar drawbacks.

Zeolite, a porous material, has a pore diameter of less than 2 nm and is classified into a microporous material. When a microporous material having an original small pore diameter is surface-treated with a silane-coupling agent or the like to suppress water absorption of inorganic particles, molecules of the silane-coupling agent entering into pores occupy a large proportion of the pores and the net pore diameters after the treatment would become small. This is supposed to prevent compounds to be adsorbed from entering the pores. Therefore, a toner is sought in which a change in characteristics due to a hygroscopic property is suppressed and harmful substances are adsorbed and removed when a porous material is used as an external additive.

SUMMARY OF THE INVENTION

An object of the present invention is to provide a toner that has excellent charge stability and minimize image deletion and blurring.

According to an aspect of the present invention, a toner is provided a toner including colored particles containing at least a binder resin and a colorant, and two or more external additives, in which at least one of the external additives includes hydrophobic treated mesoporous particles, and the mesoporous particles are inorganic particles of at least one type selected from the group consisting of silica, titanium oxide, alumina, cerium oxide, and strontium titanate.

Further, according to another aspect of the present invention, an electrophotographic apparatus is provided including a developing unit that uses the toner; and a member that is brought into contact with an electrophotographic photosensitive member to block part or all of the toner that remains on the electrophotographic photosensitive member after completing transfer to a recording medium.

In addition, according to another aspect of the present invention, an electrophotographic process cartridge is provided including a unit having the toner, and at least one unit selected from the group consisting of a charging unit, a unit having an electrophotographic photosensitive member, a transfer unit, a cleaning unit, an auxiliary charging unit and a de-charging unit, which is detachably attached to the electrophotographic apparatus.

Furthermore, according to another aspect of the present invention, an electrophotographic process cartridge is provided which is detachably mounted to an electrophotographic apparatus including a member that is brought into contact with an electrophotographic photosensitive member to block part or all of toner that remains on the electrophotographic photosensitive member after transferring the afore-mentioned toner to a recording medium, which includes at least an electrophotographic photosensitive member and an electrophotographic photosensitive member contact member for blocking remaining toner.

According to the present invention, a toner can be provided containing a specific porous external additive, thereby having excellent charge stability without adversely affecting electric properties of the toner even when used for a long period of time and having excellent image density stability without bringing about image deletion and blurring. Also, according to the present invention, an electrophotographic apparatus and an electrophotographic process cartridge detachably attached to the electrophotographic apparatus, can be provided which have excellent image density stability and do not bring about image deletion and blurring by using a specific porous external additive.

Further features of the present invention will become apparent from the following description of exemplary embodiments with reference to the attached drawing.

BRIEF DESCRIPTION OF THE DRAWING

FIGURE is a schematic diagram illustrating an example of an electrophotographic apparatus used in the present invention.

DESCRIPTION OF THE EMBODIMENTS

Figure 1:
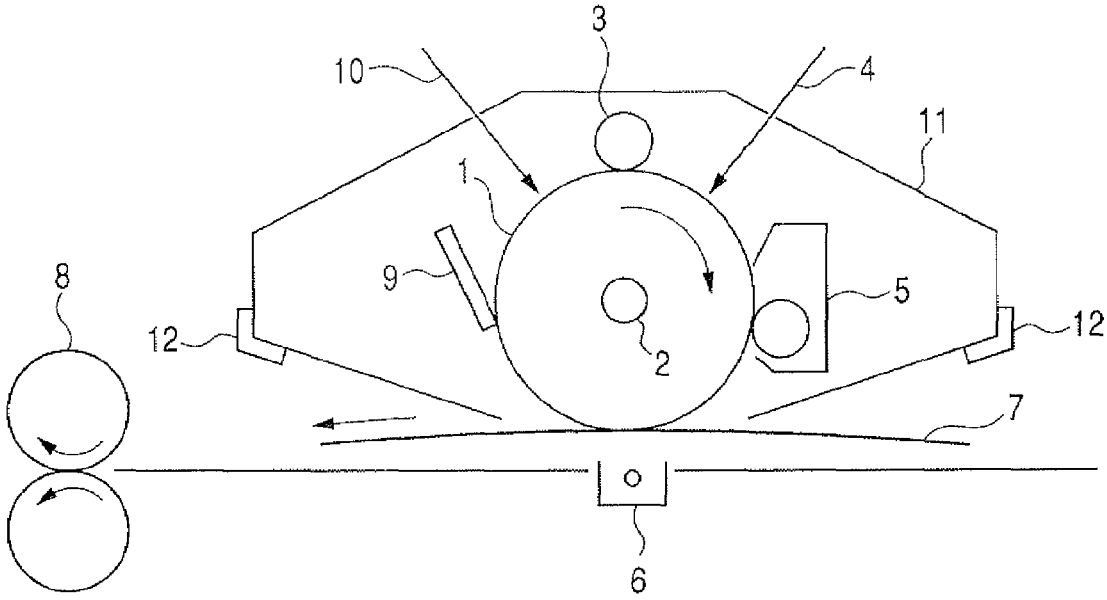

Hereinafter, exemplary embodiments of the present invention are described.

As a result of extensive studies on a toner external additive, it has now been found that a porous material contained in a toner external additive to provide a sufficient effect of adsorbing discharge induced products is preferably a mesoporous material having a pore diameter of 2 nm or more and 50 nm or less. Although details of effects of the mesoporous material are unknown, a material called a microporous material having a pore diameter of less than 2 nm is not suitable because the pore diameter of the microporous material is too small. If the porous particles are surface-treated with a silane-coupling agent or the like to suppress hygroscopicity or impart selectivity for adsorbed substances, the adsorption capability of the porous particles may be decreased. On the other hand, a porous material called a macroporous material having a pore diameter of more than 50 nm may have a decreased adsorption amount per unit mass. The surface-treating agent that can be used for suppressing hygroscopicity of the porous material includes a conventionally known silane-coupling agent having an alkyl group or an aryl group, or siloxane oil. A further study on other surface-treating agents revealed that use of a mesoporous material surface-treated with a compound having an unsubstituted or substituted amino group is particularly effective in suppressing image deletion and blurring.

A further study on the mesoporous external additive particles having an adsorption action indicated that the primary particle size of the mesoporous external additive particles is preferably 0.2 μm or more and 1.7 μm or less, more preferably 0.5 μm or more and 1.3 μm or less. If the particle size of the mesoporous external additive particles is less than 0.2 μm, the liberation ratio of the external additive from the toner is low, so the external additive is transferred simultaneously when the toner is transferred from the surface of the photosensitive member onto a recording medium, thus reducing the amount of the external additive that remain on the photosensitive member. On the other hand, if the particle size of the mesoporous external additive particles is more than 1.7 μm, the liberation ratio of the external additive itself is increased. However, drawbacks are raised in that agglomeration of leberated external additive particles occur in the developing device and the agglomerated external additive results in flaws on the surface of the photosensitive member.

The porous material of the present invention can have a BET specific surface area of 400 $m^2/g$ or more and 1,000 $m^2/g$ or less. If the specific surface area of the porous material is less than 400 $m^2/g$, the adsorption amount of discharge induced products per unit mass of external additive is decreased. Accordingly, to secure an effective adsorption amount of the discharge induced products, the amount of the mesoporous external additive should be increased. The addition amount of the external additive can not be determined unambiguously based on the absorption amount of discharge induced products, and if the amount of the external additive is too much, toner developability and fixing properties are affected. On the other hand, if the mesoporous material has a specific surface area of more than 1,000 $m^2/g$, a high adsorption amount of discharge induced products is expectable while the thickness of a wall between pores tends to be smaller. If the thickness of a wall between pores is too small, the porous material tends to have a decreased physical strength. If the physical strength of the external additive is lowered, the shape of the porous external additive particles is damaged by an abrasion effect between particles when agitating the toner in a developing device. This results in defects such that the particle size of the external additive is changed or the damaged external additive particles adversely affect the toner matrix.

As a result of a study on the composition of particles used in the porous external additive, it has been found that when the external additive itself is a cation-exchangeable compound such as zeolite or an anion-exchangeable compound such as hydrotalcite, it is difficult for the external additive to have properties that allow the electrophotographic apparatus to operate stably under various use environments. This is because although such an external additive may have an effect of adsorbing discharge induced products, the external additive material itself has ion-exchanging properties, and an electric influence the ion-exchanging properties have on surroundings greatly vary before and after adsorbing water or discharge induced products. This in turn has an influence on various properties that are important to a developer such as charge stability, development stability or flowability. A further detailed study indicated that the material of the porous external additive can be preferably selected from the group consisting of silica, titanium oxide, alumina, cerium oxide, and strontium titanate. Among these, silica or strontium titanate is more preferable.

The electrophotographic apparatus having a developing unit is preferably an electrophotographic apparatus having a member that is brought into contact with an electrophotographic photosensitive member to block part or all of the toner that remains on the electrophotographic photosensitive member after completing transfer to a recording medium. This is because blocking the toner remaining on the photosensitive member after the transfer process of the toner by contacting the electrophotographic photosensitive member contact member with the photosensitive member enables the surface of the photosensitive member to be rubbed with the remaining toner that contains the porous external additive of the present invention. This rubbing allows the discharge induced products accumulated on the surface of the photosensitive member to be more efficiently adsorbed and removed by the porous external additive.

The developing units of the electrophotographic apparatus currently widely used are roughly classified into three groups, i.e., a two-component contact developing unit having two components, a developing carrier and a developer, in a developing device with the developing carrier and the developer coming in contact with the surface of the photosensitive member; a one-component contact developing unit in which that a single component including only a developer is brought into pressure contact with the surface of the photosensitive member by means of a roller; and a jumping developing unit in which a one-component developer is kept in a non-contact state with a gap from the photosensitive member and a portion of the developer that participates in development jumps from the developing device to the surface of the photosensitive member (non-contact development). When the toner of the present invention is used, the adsorption and removal capability of the porous external additive is varied by the contact state between the developer and the surface of the photosensitive member in the developing process. The contact state is stronger in the order of the jumping development, two-component contact development, and one-component contact development, and the adsorption and removal capability of the porous external additive increases in this order. The adsorption of the discharge induced products on the porous external additive in the development process can be reduced to the phenomenon of absorption of the discharge induced products in the developing device. If the discharge induced products are absorbed excessively in the developing device, an adverse influence on developing properties such as charge properties may occur. Therefore, the capability of adsorpting and removing the discharge induced products from the photosensitive member and the capability of incorporating the discharge induced products into the developer are in a trade-off relationship. In particular, when the developing device is constructed to have a large capacitance, the jumping development is preferable because it is not largely affected by the incorporation of the discharge induced products.

In the present invention, the reason that the above-mentioned object can be achieved by a toner that includes colored particles containing at least a binder resin and a colorant and two or more external additives, in which at least one of the external additives includes hydrophobic treated mesoporous particles, is as follows.

The reason that the toner of the present invention is effective in suppressing image deletion and blurring is considered to be as follows. One of reasons for the occurrence of image deletion and blurring is thought to be a failure to retain an electrostatic latent image, which is caused by a decrease in surface electric resistance of the photosensitive member by adhesion of the discharge induced products generated in the charging process on the surface of the photosensitive member, particularly, the discharge induced products adhered under high humidity. Use of the toner that contains at least a mesoporous external additive allows the discharge induced products adhered on the surface of the photosensitive member to be selectively adsorbed in pores of the mesoporous external additive and removed from the surface of the photosensitive member. This avoids an extreme reduction in surface electric resistance at high humidity, thus the occurrence of image deletion and blurring can be suppressed.

Generally, inorganic particles or porous particles used in the external additive have high hygroscopicity, and the hygroscopicity of the external additive may cause a problem such that the electric properties and flowability of the toner are changed. When surface treatment with a silane-coupling agent is performed in order to control the hygroscopicity of the particles, if the porous external additive is a microporous material having a pore diameter of less than 2 nm, a problem is raised in that the adsorption efficiency of the compound to be originally adsorbed is decreased because the pores are sealed by molecules of the surface-treating agent. For example, assuming that the inside of pores having a diameter of less than 2 nm is surface-treated with propyltriethoxysilane, one of representative surface-treating agents, the distance between the oxygen atom and the hydrogen atom at the leading edge of the propyl group is about 5 to 6 Angstroms and only less than 1 nm is left as an effective pore diameter. Therefore, a decrease in adsorption efficiency is inevitable. On the other hand, in the case of a macroporous material having a pore diameter of more than 50 nm, a problem is raised in that adsorption amount per unit mass of the external additive is decreased. Therefore, in the present invention, a mesoporous material having a pore diameter of 2 nm or more and 50 nm or less is used as the external additive having an action of adsorbing the discharge induced products.

The definitions of micro, meso and macro for porous materials are based on what is stipulated by IUPAC.

A more preferable range of the pore diameter is 3 nm or more and 30 nm or less, and further preferably 5 nm or more and 20 nm or less.

The external additive in the present invention is treated preferably with either or both of a silane-coupling agent and a silicone oil.

Specifically, the silane-coupling agent may include hexamethyldisilazane and compounds represented by the following formula (I).

$$R_mSiY_n \quad (1)$$

R: an alkoxy group or a chlorine atom m: an integer of 1 to 3

Y: a hydrocarbon group containing an alkyl group, a vinyl group, a glycidoxy group, or a methacryl group n: an integer of 1 to 3

Provided that m+n≦4

Examples of the compound represented by the formula (I) include dimethyldichlorosilane, trimethylchlorosilane, allyldimethylchlorosilane, allylphenyldichlorosilane, benzyldimethylchlorosilane, vinyltriethoxysilane, γ-methacryloxypropyltrimethoxysilane, isobutyltrimethoxysilane, n-butyltrimethoxysilane, vinyltriacetoxysilane, divinylchlorosilane, and dimethylvinylchlorosilane.

Treatment with the silane-coupling agent may be performed by any one of a dry method in which fine particles agitated into a cloud state are allowed to react with a vaporized silane-coupling agent and a wet method in which fine particles are dispersed in s solvent and dropped to react with a silane-coupling agent.

These surface treatments not only make the inorganic external additive hydrophobic to decrease the influence of moisture, but also can control the flowability, charging property and liberation ratio of the external additive.

The mesoporous external additive of the present invention may be treated with a surface-treating agent having a substituted or unsubstituted amino group in addition to the above-mentioned silane-coupling agent and silicone oil.

The surface-treating agent having a substituted or unsubstituted amino group can be preferably silane-coupling agents having the following structural formulae AS-1 to AS-28.

AS-1

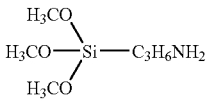

AS-2

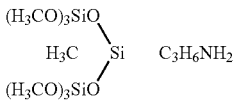

AS-3

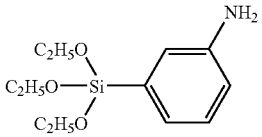

AS-4

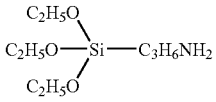

-continued

AS-5

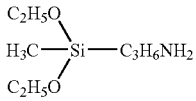

AS-6

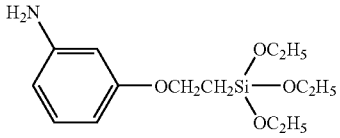

AS-7

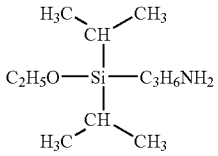

AS-8

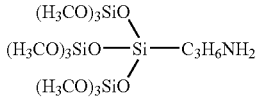

AS-9

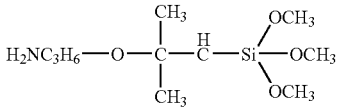

AS-10

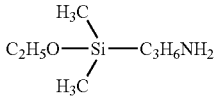

AS-11

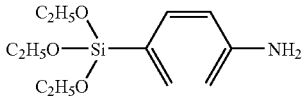

AS-12

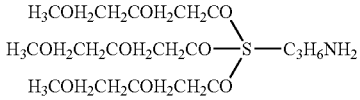

AS-13

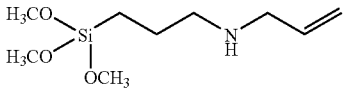

AS-14

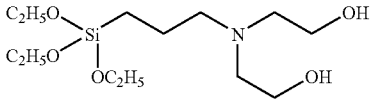

AS-15

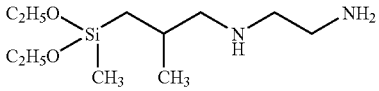

AS-16

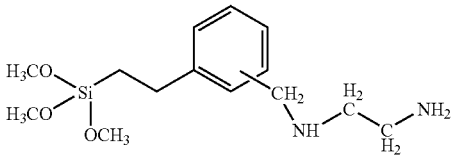

AS-17

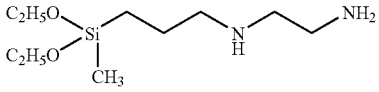

-continued

AS-18

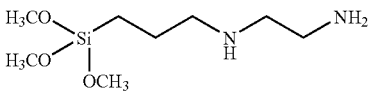

AS-19

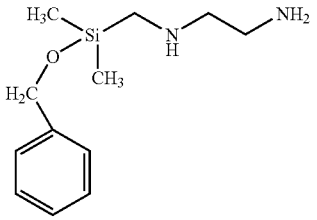

AS-20

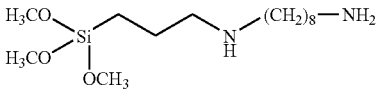

AS-21

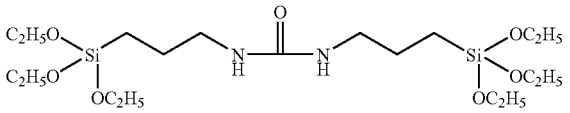

AS-22

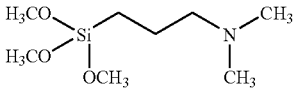

AS-23

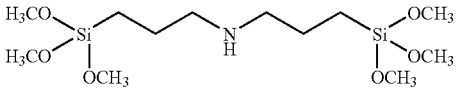

AS-24

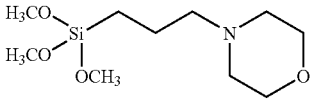

AS-25

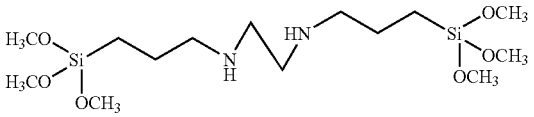

AS-26

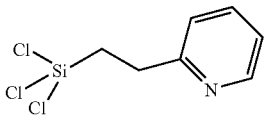

AS-27

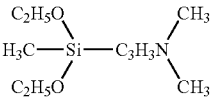

AS-28

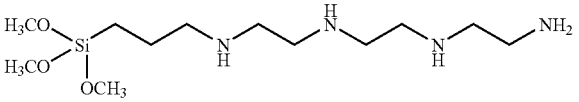

Treatment with the silane-coupling agent may be performed by any one of a dry method in which mesoporous fine particles agitated into a cloud state are reacted with a vaporized silane-coupling agent and a wet method in which mesoporous fine particles are dispersed in a solvent and dropped to react with a silane-coupling agent.

The surface treatment enables a mesoporous inorganic external additive to selectively adsorb the discharge induced products mainly in the pores and remove them.

In the present invention, the mesoporous inorganic external additive may be subjected to both a surface treatment for increasing hydrophobicity and a surface treatment for promoting selective adsorption of the discharge induced products. In this case, the order of treatments is not particularly limited and a plurality of surface treatments can be performed step by step or simultaneously using a plurality of surface-treating agents.

A mesoporous inorganic external additive can be prepared as follows. According to the method described in Science 269:1242 (1995); Angew. Chem. Int. Ed. Engl. 1996, 35(5) 1102; Chem. Mater. 8, 1451 (1996); Chem. Mater., 2001, 13(7):2392-2396; Chem. Mater., 2005, 17(17):4514-4522; Ind. Eng. Chem. Res., 2004, 43(12):3019-3025; J. Phys. Chem. B., 1999, 103(43):9328-9332, a conventionally known mesoporous material is prepared to have a desired particle size and surface-treated with the above-mentioned silane-coupling agent. In particular, one prepared by utilizing a sol-gel reaction of a desired external additive such as silicon or titanium and using the micelle structure of a surfactant as a template is preferable. In a structure such as silica gel that adsorbs substances by a gap between fine particles formed by agglomeration of ultrafine particles, the physical strength may be decreased. If the physical strength of the structure is decreased, the shape of the porous external additive particles is damaged by the friction between particles when the toner is agitated in the developing device. As a result, the particle size of the external additive is changed or the damaged external additive particles may have an influence on the toner matrix.

The toner external additive of the present invention can be a mesoporous external additive having structural periodicity in which at least one diffraction peak in an angle region corresponding to a periodical structure of 1 nm or more in X-ray diffraction measurement.

Low softening point substances that can be contained in the toner of the present invention include, for example, paraffin waxes, polyolefin waxes, modified products thereof (for example, oxides and graft-treated products), higher fatty acids and metal salts thereof, amide waxes, ketone waxes, and ester waxes. When used in color toners, amide waxes, ketone waxes and ester waxes are preferable because high crystallinity impairs transmissivity of OHP.

The low softening point substance can be blended in an amount of 1 to 35 mass parts, preferably 5 to 30 mass parts, with respect to 100 mass parts of the binder resin.

The binder resin used in the toner of the present invention includes the following.

Examples of the binder resin include: monopolymers of styrene and a substituted product thereof such as polystyrene, poly-p-chlorostyrene, and polyvinyltoluene; styrene-based copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-α-methyl chloromethacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, and a styrene-acrylonitrile-indene copolymer; polyvinyl chloride; phenol resins; natural or modified phenol resins; natural or modified maleic acid resins; acrylic resins; methacrylic resins; polyvinyl acetate; silicone resins; polyester resins; polyurethane; polyamide resins; furane resins; epoxy resins; xylene resins; polyvinyl butyral; terpene resins; coumarone indene resins; and petroleum-based resins. Preferable examples of the binder resin include the styrene-based copolymers and the polyester resins.

Examples of the co-monomer for the styrene monomer of a styrene-based copolymer include: monocarboxylic acid having a double bond and a substituted product thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acid having a double bond and a substituted product thereof such as maleic acid, butyl maleate, methyl maleate, and dimethyl maleate; vinyl esters such as vinyl chloride, vinyl acetate, and vinyl benzoate; ethylene-based olefins such as ethylene, propylene, and butylene; vinyl ketones such as vinyl methyl ketone and vinyl hexyl ketone; and vinyl ethers such as vinyl methyl ether, vinyl ethyl ether, and vinyl isobutyl ether. The co-monomers may each be used alone or in combination.

The styrene polymers or styrene copolymers may be crosslinked or a mixed resin of a crosslinked resin and a non-crosslinked resin.

As a crosslinking agent for the binder resin, a compound having two or more polymerizable double bonds may be used. Aromatic divinyl compounds, for example, divinylbenzene and divinylnaphthalene; carboxylic acid esters having two double bonds, for example, ethylene glycol diacrylate, ethylene glycol dimethacrylate, and 1,3-butanediol dimethacrylate; divinyl compounds, for example, divinylaniline, divinyl ether, divinyl sulfide, and divinylsulfone; and compounds having three or more vinyl groups may be used alone or in combination.

The addition amount of the crosslinking agent may be 0.001 to 10 mass parts based on 100 mass parts of the polymerizable monomer.

The toner of the present invention can contain a charge controlling agent.

Substances that can control the toner so as to be negatively charged include the following.

For example, organic metal compounds and chelate compounds are effective, and monoazo metal compounds, acetylacetone metal compounds, aromatic hydroxycarboxylic acids and aromatic dicarboxylic acid metal compounds are enumerated. Other examples include aromatic hydroxycarboxylic acids, aromatic mono- and polycarboxylic acids, and metal salts, anhydrides and esters thereof as well as phenol derivatives such as bisphenols. Further examples include urea derivatives, metal-containing salicylic acid compounds, metal-containing naphthoic acid compounds, boron compounds, quaternary ammonium salts, calixarene, silicon compounds, styrene-acrylic acid copolymer, styrene-methacrylic acid copolymer, styrene-acrylic-sulfonic acid copolymer, and non-metal carboxylic acid compounds. Also, a resin in which the above-mentioned charge controlling compound is incorporated may be internally added in the toner.

Substances that can control the toner so as to be positively charged include the following.

Examples of the substance include: nigrosine and products thereof modified with fatty acid metal salts; guanidine compounds, imidazole compounds; quaternary ammonium salts such as tributylbenzylammonium-1-hydroxy-4-naphthosulfonic acid salts and tetrabutylammonium tetrafluoroborate; and analogues thereof such as onium salts such as phosphonium salts and lake pigments thereof; triphenylmethane dyes and lake pigments thereof (laking agents include phosphorus tungstenate, phosphorus molybdenate, phosphorus tungsten molybdenate, tannic acid, lauric acid, gallic acid, ferricyamide, and ferrocyamide); metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate. The substances may each be used alone or in combination. Among these, charge controlling agents such as nigrosine and quaternary ammonium salts are used particularly preferably. Also, resins with the above-mentioned charge controlling compounds incorporated therein may be internally added to the toner.

The charge controlling agent is used preferably in an amount of 0.01 to 20 mass parts, more preferably 0.5 to 10 mass parts, based on 100 mass parts of the resin component.

The colorant used in the present invention include, as a black colorant, carbon black, grafted carbon and one toned to black by using yellow/magenta/cyan colorants.

Examples of the typical compound which is used as a yellow colorant include: condensed azo compounds; an isoindoline compound; an anthraquinone compound; an azo metal complex; a methine compound; and an allyl amide compound. Specifically, C.I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 166, 168, 169, 177, 179, 180, 181, 183, 185, 191, 192, 170, 199 can be preferably used.

Dyes include C.I. Solvent Yellow 33, 56, 79, 82, 93, 112, 162, and 163; C.I. Disperse Yellow 42, 64, 201, and 211.

If necessary, yellow pigments or dyes may be used alone or several pigments or dyes may be used in combination.

Examples of the compound which is used as a magenta colorant include: condensed azo compounds; a diketopyrrolopyrrol compound; anthraquinone; a quinacridone compound; a basic dye lake compound; a naphtol compound; a benzimidazolone compound; a thioindigo compound; and a perylene compound. Specifically, C.I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, and 254, and C.I. Pigment Violet 19 are particularly preferable.

If necessary, magenta pigments or dyes may be used alone or several pigments or dyes may be used in combination.

Examples of the cyan colorant to be used in the present invention include: a copper phthalocyanine compounds or derivatives thereof; an anthraquinone compound; and a basic dye lake compound. Specifically, C.I. Pigment Blue 1, 7, 15, 15:1, 15:2, 15:3, 15:4, 60, 62, 66 are particularly preferable.

If necessary, cyan pigments or dyes may be used alone or several pigments or dyes may be used in combination.

The colorants may be used alone or as mixtures. Further, the colorants may be used in a solid solution state. The colorants of the present invention are selected from hue angle, chroma, brightness, weatherability, OHP transmissivity, and dispersibility in toner. The addition amount of the colorants is 1 to 20 mass parts based on 100 mass parts of resin.

Next, the method for producing the toner used in the present invention is described. The toner used in the present invention can be produced by a pulverization toner production method and a polymerization toner production method.

In the present invention, the pulverization toner production method includes sufficiently mixing a binder resin, a low softening point substance, a pigment, a dye or a magnetic substance as a colorant, a charge controlling agent as needed, and other additives in a mixer such as a Henschel mixer or a ball mill; melt-kneading the obtained mixture by using a hot kneading machine such as a hot roll, a kneader or an extruder to disperse or dissolve the low softening point substance, pigment, dye and magnetic substance in the resin components compatibilized with each other; and subjecting the obtained kneaded product to pulverization and classification after cool solidification.

Further, if necessary, desired additives are sufficiently mixed with the above-obtained toner in a mixer such as Henschel mixer to obtain a toner that can be used in the present invention.

In the present invention, the polymerized toner can be produced by a method in which a molten mixture is sprayed into air by using a disc or a multi-fluid nozzle to obtain spherical toner as described in Japanese Patent Publication No. S56-013945, a method in which toner is directly produced by using a suspension polymerization method, a dispersion polymerization method in which toner is directly produced by using an aqueous organic solvent in which the polymer soluble in the monomer is insoluble, or an emulsion polymerization method typified by a soap-free polymerization method in which toner is produced by directly performing polymerization in the presence of a water-soluble polar polymerization initiator, or a hetero agglomeration method in which a primary polar emulsion polymerization particles are prepared in advance and then associated with each other by adding polar particles having opposite charges, as described in Japanese Patent Publication No. S36-010231, Japanese Patent Application Laid-Open No. S59-053856, and Japanese Patent Application Laid-Open No. S59-061842.

However, in the dispersion polymerization method, while the toner obtained by the dispersion polymerization method shows extremely sharp particle size distribution, the materials to be used are selected from a narrow range, use of organic solvents is involved with disposal of waste solvents and inflammability of solvents, and the production apparatus tends to be complex and cumbersome in handling. The emulsion polymerization method represented by the soap-free polymerization is effective since the particle size distribution of the toner is relatively uniform. However, when the used emulsifier and initiator ends are present on the surface of the toner particles, environmental properties tend to deteriorate.

Therefore, in the present invention, a suspension polymerization method at an atmospheric pressure or under pressure by which fine particle toner with a sharp particle size distribution can be obtained relatively easily is particularly preferable. The so-called seed polymerization method in which a monomer is further adsorbed on the polymer particles previously obtained and then polymerized using a polymerization initiator can also be advantageously used in the present invention.

When a direct polymerization method is used for producing the toner of the present invention, the toner can be produced specifically by the following production method. That is, a low softening point substance, a colorant, a charge controlling agent, a polymerization initiator, and other additives are added in a monomer and the resultant mixture is uniformly dissolved or dispersed by a homogenizer, an ultrasonic disperser or the like to form a monomer system. Then, the monomer system is dispersed into an aqueous phase containing a dispersion stabilizer by using an ordinary mixer or a homomixer, a homogenizer or the like. Granulation of the resultant mixture is performed with adjusting the agitation speed/time so that monomer droplets can have a desired toner particle size. Thereafter, the particle state is maintained by the action of the dispersion stabilizer, and agitation can be performed to such an extent that the sedimentation of particles is prevented. The polymerization is performed after the polymerization temperature is set at 40° C. or more, generally 50 to 90° C. Further, the temperature may be raised in the latter half of the polymerization reaction. Further, to remove unreacted polymerizable monomers, side products and so on causative of odor at the time of fixing the toner, a portion of the aqueous medium may be distilled off in the latter half of the reaction or after the reaction is completed. After completion of the reaction, the produced toner particles are collected by washing/filtration and dried. In the suspension polymerization method, usually 300 to 3,000 mass parts of water based on 100 mass parts of monomer system can be used as a dispersing medium.

A more preferable toner used in the present invention is produced by a direct polymerization method in which the low softening point substance is included by the shell resin layer as observed by a section measuring method of the toner by using a transmission electron microscope (TEM). Since a large amount of low softening point substance needs to be added to the toner from the viewpoint of fixability, it is necessary to have the low softening point substance included in the shell resin. When the low softening point substance is not included by the shell resin layer, the toner can not be subjected to sufficient pulverization unless special freezing pulverization is used in the pulverization process. As a result, only a toner that has broad particle size distribution can be obtained and the toner is undesirably fusion bonded to the apparatus. In the freezing pulverization, the apparatus becomes complicated because of a countermeasure for preventing dew formation on the apparatus, and when the toner absorbs moisture, the workability of the toner is decreased and a drying step will be necessary to be added, thus causing a problem. In a specific method for including the low softening point substance, the polarity of materials in an aqueous medium is so set that the polarity of the low softening point substance is lower than that of the main monomer, and further a small amount of a resin or monomer having high polarity is added to obtain a toner having the so-called core-shell structure. The particle size distribution and particle size of the toner can be controlled by a method of changing the type and addition amount of an inorganic salt hardly soluble in water or a dispersing agent having protective colloid action or by controlling mechanical apparatus conditions, for example, agitation conditions such as the peripheral speed, the number of passes and the shape of an agitating vane of a rotor and the vessel shape or the solid concentration in an aqueous solution, so that the predetermined toner of the present invention can be obtained.

In the present invention, a specific method by which the section measuring method of the toner is performed as follows. A toner is sufficiently dispersed in a normal temperature curing epoxy resin and then the dispersion is cured in an atmosphere at a temperature of 40° C. for 2 days. The resulting cured product is dyed with triruthenium tetroxide, if necessary, in combination with triosmium tetroxide. Then, a sample in the form of a thin section is cut out using a microtome with a diamond blade. The sample is measured for the section using a transmission electron microscope (TEM). In the present invention, a triruthenium tetroxide dyeing method can preferably be used to create a contrast between the materials utilizing a slight difference in crystallinity between the low softening point substance and the resin constituting the shell.

As the vinyl-based polymerizable monomers capable of performing radical polymerization, used to produce the toner by the polymerization method, monofunctional polymerizable monomers or polyfunctional polymerizable monomers may be used.

Examples of the monofunctional polymerizable monomers include: styrene; styrene-based polymerizable monomers such as α-methylstyrene, β-methylstyrene, o-methyl-styrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic-based polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxy ethyl acrylate; methacryl-based polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; methylene aliphatic monocarboxylic acid esters; vinyl esters such as vinyl acetate, vinyl propionate, vinyl benzoate, vinyl butyrate, vinyl benzoate, and vinyl formate; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone.

Examples of the polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxy-diethoxy)phenyl]propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy-diethoxy)phenyl]propane, 2,2'-bis[4-(methacryloxy-polyethoxy)phenyl]propane, trimethylolpropane trimethacrylate, tetramethylolmethane tetramethacrylate, divinyl benzene, divinyl naphthalene, and divinyl ether.

The monofunctional polymerizable monomers may each be used alone or in combination. The monofunctional polymerizable monomers and the polyfunctional polymerizable monomers may be used in combination. The polyfunctional polymerizable monomers may be used as a crosslinking agent.

In the present invention, to form a core-shell structure in the toner, polar resins may preferably be used in combination. The polar resins such as polar polymers and polar copolymers usable in the present invention are exemplified as follows.

Preferable examples of the polar resins include polymers of nitrogen-containing monomers such as dimethylaminoethyl methacrylate and diethylaminoethyl methacrylate, or copolymers of the nitrogen-containing monomers and styrene-unsaturated carboxylic esters; polymers of nitrile-based monomers such as acrylonitrile; polymers of halogen-containing monomers; polymers of unsaturated carboxylic acids such as acrylic acid and methacrylic acid; polymers of unsaturated dibasic acids; polymers of unsaturated dibasic acid anhydrides; polymers of nitro monomers or copolymers of the nitro monomers with styrene-based monomers; polyesters; and epoxy resins. More preferable examples of the polar resins include copolymers of styrene with (meth)acrylic acid, maleic acid copolymers, saturated or unsaturated polyester resins, and epoxy resins.

Examples of the polymerization initiator include: azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl oxycarbonate, cumene hydroperoxide, t-butyl hydroperoxide, di-t-butyl peroxide, di-cumyl peroxide, 2,4-dichlorobenzoyl peroxide, lauroyl peroxide, 2,2-bis(4,4-t-butyl cyclohexyl peroxide)propane, and tris-(t-butyl peroxide)triazine, or polymer initiators having a side chain with peroxide, potassium persulfate, ammonium persulfate or hydrogen peroxide.

Those polymerization initiators are preferably added in an amount of 0.5 to 20 mass parts based on 100 mass parts of the polymerizable monomer, and may each be used alone or in combination.

A known crosslinking agent or a chain transfer agent may be added for controlling the molecular weight of the binder resin. The addition amount of the chain transfer agent is preferably 0.001 to 15 mass parts with respect to 100 mass parts of the polymerizable monomer.

In the present invention, the dispersion medium used when a polymerization toner is produced by a polymerization method using emulsion polymerization, dispersion polymerization, suspension polymerization, seed polymerization and hetero agglomeration may contain a suitable stabilizer. Inorganic compounds that can be used as the stabilizer include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Organic compounds that can be used as the stabilizer include: polyvinyl alcohol; gelatin; methylcellulose; methylhydroxypropylcellulose; ethylcellulose; a sodium salt of carboxymethylcellulose; polyacrylic acid and a salt thereof; polymethacrylic acid and salts thereof; starch; polyacrylamide; polyethyleneoxide; and nonionic surfactants or ionic surfactants.

In the case where the emulsion polymerization method and hetero agglomeration method are used, anionic surfactants, cationic surfactants, amphoteric surfactants or nonionic surfactants are used. The stabilizer can be used in an amount of 0.2 to 30 mass parts based on 100 mass parts of the polymerizable monomer.

Among the dispersion stabilizers, when an inorganic compound is used, a commercially available inorganic compound may be directly used. Alternatively, the inorganic compound may be produced in an aqueous dispersion medium in order to obtain fine particles.

A surfactant may be used in an amount of 0.001 to 0.100 part by mass based on 100 mass parts of the polymerizable monomer for finely dispersing the dispersion stabilizer. The use of the surfactant is aimed at promoting the desired action of the above dispersion stabilizer. Specific examples of the surfactant include sodium dodecylbenzenesulfonate, sodium tetradecyl sulfate, sodium pentadecyl sulfate, sodium octyl sulfate, sodium oleate, sodium laurate, sodium stearate, and calcium oleate.

The toner of the present invention can be used usually as a one-component or two-component developer. When a non-magnetic toner that contains no magnetic substance is used as a one-component developer, a blade or a roller is used and the toner is forcibly triboelectrically charged by a developing sleeve and attached to the developing sleeve, thus transported.

Next, a carrier that can be used in the two-component developer will be described.

50% particle size based on volume and particle size distribution of the carrier particles of the present invention can be measured by using a laser diffraction particle size distribution measuring device (HELOS) equipped with a dry dispersing machine (RODOS) manufactured by SYNPATEC Co. under conditions of a feed air pressure of 300 kPa (3 bar) and a suction pressure of 10 kPa (0.1 bar).

The carrier particles may have 50% particle size (D) based on volume of preferably 15 to 6o μm, more preferably 25 to 50 μm. Further, in the carrier, a content of particles having a diameter 2/3 or less times the 50% particle size (2D/3≧) is preferably 5 vol. %, more preferably 0.1 to 5 vol. %.

When the 50% particle size of the carrier is less than 15 μm, the adhesion to non-image portions of particles on the finer particle side of the particle size distribution of the carrier can not be well prevented in some cases. When the 50% particle size of the carrier is greater than 60 μm, while no streaks due to stiffness of the magnetic brush occurs, image unevenness may occur due to the large size.

The electrophotographic photosensitive member used in the image-forming apparatus of the present invention may be an inorganic photosensitive member formed from an inorganic compound such as amorphous silicon or an organic photosensitive member formed mainly from an organic compound, which are conventionally known.

In the present invention, it is preferable to include a member that contacts with an electrophotographic photosensitive member for blocking part or all of the toner that remains on the electrophotographic photosensitive member after the toner is transferred on a recording medium. The toner remaining on the electrophotographic photosensitive member is blocked so that the discharge induced products adhering to the surface of the photosensitive member can be more efficiently adsorbed and removed by the friction between the mesoporous inorganic external additive and the surface of the photosensitive member. As the member that blocks the remaining toner on the photosensitive member, a plate-like member, a rubber-like member, a sponge-like member or a brush-like member may be used. However, a member having too strong a mechanical strength may damage the photosensitive member, such as occurrence of flaws. Also, when the force with which bring the member into contact with the photosensitive member is too weak or the member has a shape having many gaps, the toner may be difficult to block in a portion of the photosensitive member. From these viewpoints, the blocking member is preferably a rubber-like member, a sponge-like member or a brush-like member. While these members are set in the electrophotographic apparatus especially to block the remaining toner, they can be used to serve also as other auxiliary members such as a cleaning member and a charging member used in the conventional electrophotographic apparatus.

Currently, the charging systems mainly used in electrophotographic apparatus include a non-contact system and a contact system. The non-contact type system uses corona discharge. On the other hand, the contact type system utilizes discharge occurring in a gap slightly outside the site where a charging member is abutted against the electrophotographic photosensitive member when voltage is applied to the charging member coming in contact with the photosensitive member. The latter contact system is divided into a system in which the voltage applied is composed of only a direct current component (hereinafter, DC charging) and an AC-DC charging system in which the voltage applied is composed of a direct current component and an alternate current component superimposed thereon having a wave height exceeding a discharge starting voltage (hereinafter, AC-DC charging). Of these three types of charging systems, the DC charging produces a relatively small amount of discharge induced products, thus image defects are less likely to occur due to the discharge induced products. In the AC-DC charging, the amount of the discharge induced products as such is small as compared with the corona discharge, but is a system in which charged particles directly impact the photosensitive member, chemical bonds on the surface of the photosensitive member are broken, undergoing oxidative deterioration of the surface of the photosensitive member so that the surface of the photosensitive member is changed to have a composition that is apt to adsorb the discharge induced products. Therefore, the effect of the toner of the present invention of selectively absorbing the discharge induced products adsorbed on the surface of the photosensitive member can be effectively exhibited. Since corona discharge produces a large amount of the discharge induced products, the effect of the toner of the present invention of absorbing the discharge induced products can be effectively exhibited.

Next, the electrophotographic apparatus using the toner of the present invention will be described.

FIGURE illustrates a specific example of an electrophotographic apparatus that includes the electrophotographic photosensitive member of the present invention. This apparatus includes a photographic photosensitive member 1, a primary charging unit 3, an image exposing unit 4, a developing unit 5, and a transfer unit 6 on the peripheral surface of the photosensitive member 1. The photosensitive member 1 has a rotational axis 2.

An image is formed by the following method. First, a voltage is applied to a primary charging unit 3 to charge the surface of the photosensitive member 1, and an image corresponding to an original is subjected to image exposure by the image exposing unit 4 to form a static latent image the surface of the photosensitive member 1. Then, a toner in the developing unit 5 is attached to the photosensitive member 1 to develop (visualize) the static latent image. Further, the toner image formed on the photosensitive member 1 is transferred by the transfer unit 6 onto a transfer material 7 such as paper supplied. The transfer material 7 on which the toner image is transferred is separated from the surface of the photosensitive member and transported to an image fixing unit 8 where the toner image on the transfer material 7 is fixed and then printed out as an image product (print or copy) to the outside of the apparatus. The remaining toner not transferred by the transfer material is recovered by a cleaning unit 9. In recent years, a cleaner-less system has been studied and the remaining toner can be directly recovered by the developing device. Further, the recovered toner is de-charged by pre-exposure light from a pre-exposing unit 10 and then repeatedly used for forming images. The pre-exposing unit is not indispensable.

In the image-forming apparatus, the light source of the image exposing unit 4 may be, for example, a halogen light lamp, a fluorescent lamp, a laser light source or an LED. If necessary, the image-forming apparatus may include another auxiliary unit, for example, an auxiliary charging unit.

In the present invention, a plurality of units out of the constituent elements such as the above-mentioned developing unit (a unit having a toner) 5, photosensitive member (a unit having a photosensitive member) 1, primary charging unit (a charging unit) 3, transfer unit 6, cleaning unit 9, pre-exposing unit (a neutralizing unit) 10, and the auxiliary charging unit (not shown) may be integrally combined together to form a process cartridge so as to be detachably mounted to the body of the electrophotographic apparatus. For example, at least one of the primary charging unit 3, the developing unit 5, and the cleaning unit 9 is integrally supported together with the photosensitive member 1 by a supporting unit (not shown) to form a cartridge 11, which is detachably mounted to the body of the electrophotographic apparatus by a guiding unit such as a rail 12 of the body of the apparatus. Further, when the electrophotographic apparatus is a copier or a printer, the image exposure unit 4 uses reflected light or transmitted light from an original, or light emitted according to scanning with laser beams or driving an LED array or a liquid crystal shutter array in accordance with signals into which an original is converted.

EXAMPLES

The basic constructions and features of the present invention have been described in the foregoing, and the present invention is more specifically described by way of examples. The present invention is by no means limited to those embodiments. The "part(s)" in the following examples is by mass.

Electrophotographic photosensitive member 1

50 parts of titanium oxide powder coated with tin oxide containing 10% of antimony oxide, 25 parts of resol-type phenol resin, 20 parts of methylcellosolve, parts of methanol and 0.002 part of silicone oil (polydimethylsiloxane/polyoxyalkylene copolymer, weigh average molecular weight 3,000) were dispersed in a sand mill using glass beads of 1 mm in diameter for 2 hours to prepare a coating composition for an electroconductive layer. An aluminum cylinder having a length of 260.5 mm and a diameter of 30 mm (JIS-A3003 aluminum alloy) was dip-coated with the coating composition for an electroconductive layer, and dried at 140° C. for 30 minutes to form an electroconductive layer having a thickness of 20 μm.

Then, a 5 mass % methanol solution of a polyamide resin (trade name: AMILAN CM 8000, manufactured by Toray Industries) was applied on the electroconductive layer by a dip-coating method to form an intermediate layer having a thickness of 0.5 μm.

Then, 3 parts of hydroxygallium phthalocyanine having a maximum peak at a Bragg angle 2θ±0.2° of 28.1° in CuKα characteristic X-ray diffraction as a charge generating substance and 2 parts of polyvinylbutyral resin (trade name: S-LEC BX-1, manufactured by Sekisui Chemical Co., Ltd.) were added to 100 parts of cyclohexanone and dispersed in a sand mill using glass beads having a diameter of 1 mm for 1 hour. The resultant product was diluted by addition of 100 parts of methyl ethyl ketone to prepare a coating composition for a charge generating layer. The coating composition for a charge generating layer was applied by a dip-coating method on the intermediate layer and dried at 90° C. for 10 minutes to form a charge generating layer having a thickness of 0.17 μm.

Then, 6.5 parts of a charge transporting substance having the structure represented by the following formula:

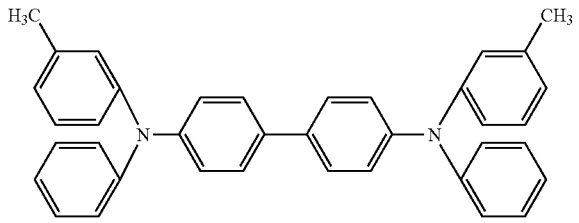

and 10 parts of a bisphenol Z type polycarbonate (trade name: Z-400, manufactured by Mitsubishi Gas Chemical Co., Ltd.) were dissolved in a mixed solvent of 60 parts of monochlorobenzene/20 parts of methylal. The resulting solution was applied by a dip-coating method on the charge generating layer and dried at 110° C. for 1 hour to form a charge transporting layer having a thickness of 14 μm.

Further, 6 parts of a hydroxy group-containing charge transporting substance represented by the following formula:

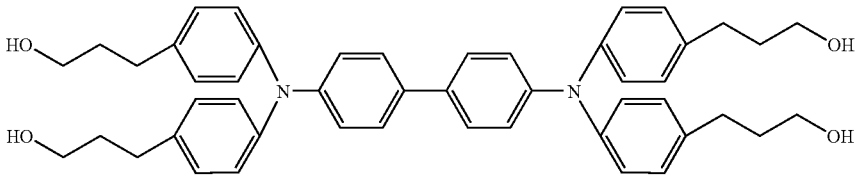

and 10 parts of a siloxane compound represented by the following formula:

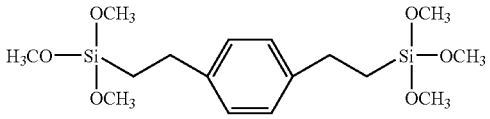

were dissolved in a mixed solution of 50 parts of methanol and 10 parts of acetone, and thereto, 0.1 part of dibutyltin acetate was added to prepare a coating composition for a protective layer. The coating composition for a protective layer was applied by a dip-coating method on the charge transporting layer and heated at 140° C. for 1 hour to cause methanol elimination condensation reaction to form a curable surface protective layer having a thickness of 3 μm.

<Polyester Resin: P-1>

In a reaction vessel, 47 parts of 2 mole propylene oxide adduct of bisphenol A, 20 parts of 2 mole ethylene oxide adduct of bisphenol A, 2 parts of 4 mole propylene adduct of novolak-type phenol resin (number of nuclei: 4), 24 parts of terephthalic acid, 2 pats of fumaric acid, 5 parts of trimellitic anhydride, 4 parts of polyethylene wax (softening point: 101° C., Mn: 720, Mw/Mn: 1.33), and 0.5 part of dibutyltin oxide were placed. The resultant mixture was subjected to condensation polymerization at 210° C. to prepare a polyester resin. The polyester resin had an acid value of 30 mgKOH/g and a Tg of 56° C.

<Mesoporous External Additive: A-1>

A block copolymer surfactant including ethylene glycol and propylene glycol (PLURONIC-P123: manufactured by BASF) was dissolved in deionized water to produce an aqueous 20 mass % solution. 100 parts of the aqueous surfactant solution, 50 parts of 35 mass % hydrochloric acid, and 125 parts of deionized water were mixed to obtain a transparent solution. While stirring the solution, 135 parts of sodium silicate (15 mass % $SiO_2$, 5.1 mass % $Na_2O$) was slowly added to prepare a white reaction mixture. The reaction mixture had a pH of about 3. The reaction mixture was retained at 30° C. for 10 hours while stirring the reaction mixture, and then, the temperature was elevated to 80° C. and the reaction mixture was retained at this temperature for 12 hours to generate mesoporous silica having the surfactant included in the pores thereof.

Then, a polytetrafluoroethylene pot was filled with 390 parts of the above-mentioned reaction mixture and 1,500 parts of zirconia beads having a diameter of 2 mm and sealed in a state that no dead volume is present in the pot. Thereafter, the reaction mixture was pulverized in a bead mill. Then, the treated solution was centrifuged to produce precipitate. The precipitate was dispersed in deionized water and centrifuged again. This operation was repeated to remove hydrochloric acid and sodium chloride in the treated solution, and then, the treated solution was centrifuged and dried at 120° C. for 10 hours to produce mesoporous silica. The mesoporous silica was calcined at 400° C. for 8 hours to remove the surfactant and then exposed to an atmosphere at 40° C./85% RH for 24 hours to generate silanol groups on the inner surface of the pores of the mesoporous silica. Thereafter, a surface treating solution prepared by dissolving 100 parts of a silane-coupling agent, for example, AS-4, in 900 parts of n-hexane was added to the mesoporous silica and the resultant mixture was vigorously agitated for 6 hours. Then, after centrifugation and addition of n-hexane/agitation operation were repeated three times to remove the excessive silane-coupling agent. The mesoporous silica thus obtained was centrifuged and dried to generate mesoporous silica having amino groups on the inner surfaces of the pores.

Measurement of physical properties of the mesoporous silica thus obtained revealed that the mesoporous silica had a specific surface area of 700 $m^2/g$, a pore diameter of 7.1 nm and a particle size of 1.0 μm. This was named External Additive A-1.

The term "specific surface area" refers to a specific surface area obtained by adsorption of nitrogen based on ASTM Standard D3663-78 established from the method of BRUNAUER-EMMETT-TELLER described in The Journal of American Chemical Society, 60, 309, (1938) (so-called BET method).

The term "pore size" refers to a peak value of pore distribution (Barrett-Joyner-Halenda: BJH model) measured by adsorption of nitrogen. The nitrogen adsorption-desorption isotherm equation based on the BJH model is described by E. P. Barrett, L. G. Joyner, and P. P. Halenda in The Journal of American Chemical Society, 73, 373, (1951).

The particle size was measured as follows. First, mesoporous silica was dispersed in deionized water to a mesoporous silica concentration of 3 mass % and treated by an ultrasonic disperser for about 5 minutes to prepare a measuring solution. In the measuring solution, a volume-based average diameter was measured using a light scattering diffraction-type particle size distribution measuring device (manufactured by Coulter Co., COULTER LS-230), and the obtained value was adopted as an average particle size. In the measurement, the refractive index of water as a dispersion medium was deemed to be 1.332, and the refractive index of silica was deemed to be 1.458.

Further, X-ray diffraction analysis (X' Pert PRO, Philips) indicated that a clear diffraction peak was observed at a surface separation of 5 nm and a diffraction pattern attributable to a hexagonal structure was obtained. Therefore, the structure of the mesoporous silica can be said to have regularity.

Table 1 shows the physical properties of other mesoporous inorganic external additives.

TABLE 1

Types and Physical Properties of Mesoporous Inorganic External Additives

| External additive No. | Material | Specific surface area ($m^2/g$) | Particle size (μm) | Pore size (nm) | Surface treating agent |
|---|---|---|---|---|---|
| A-1 | Silica | 700 | 1.0 | 7.1 | AS-4 |
| 2 | ↑ | 500 | 1.0 | 10.0 | ↑ |
| 3 | ↑ | 300 | 1.0 | 16.7 | ↑ |
| 4 | ↑ | 900 | 1.0 | 5.6 | ↑ |
| 5 | ↑ | 1,100 | 1.0 | 4.5 | ↑ |
| 6 | ↑ | 500 | 0.12 | 10.0 | ↑ |
| 7 | ↑ | 500 | 0.2 | 10.0 | ↑ |
| 8 | ↑ | 500 | 0.4 | 10.0 | ↑ |
| 9 | ↑ | 700 | 0.7 | 7.1 | ↑ |
| 10 | ↑ | 500 | 1.3 | 10.0 | ↑ |
| 11 | ↑ | 500 | 1.6 | 10.0 | ↑ |
| 12 | ↑ | 500 | 2.2 | 10.0 | ↑ |
| 13 | ↑ | 700 | 1 | 7.1 | AS14 |
| 14 | ↑ | 700 | 1 | 7.1 | AS28 |
| 15 | ↑ | 900 | 1 | 1.1 | AS28 |
| 16 | ↑ | 700 | 1 | 7.1 | No treatment |
| 17 | ↑ | 500 | 1 | 10.0 | Hexamethyldisilazane |
| 18 | ↑ | 50 | 0.03 | None | Hexamethyldisilazane |
| 19 | ↑ | 110 | 0.012 | None | Hexamethyldisilazane |
| B-1 | Anatase type titania | 450 | 1 | 11.1 | AS-4 |
| B-2 | ↑ | 600 | 0.3 | 8.3 | ↑ |
| B-3 | ↑ | 600 | 0.7 | 8.3 | ↑ |
| C-1 | Alumina | 500 | 1.4 | 10.0 | ↑ |
| C-2 | ↑ | 700 | 0.7 | 7.1 | ↑ |
| C-3 | ↑ | 500 | 0.4 | 10.0 | ↑ |
| D-1 | Cerium oxide | 400 | 0.5 | 12.5 | ↑ |
| D-2 | ↑ | 400 | 1.2 | 12.5 | ↑ |
| E-1 | Strontium titanate | 450 | 1.2 | 11.1 | ↑ |
| E-2 | ↑ | 450 | 0.3 | 11.1 | ↑ |
| E-3 | ↑ | 2.4 | 0.9 | None | ↑ |
| F-1 | Zeolite | 600 | 0.7 | 0.9 | No treatment |

Example 1

| | |
|---|---|
| Polyester resin: P-1 | 100 parts |
| Magnetic iron oxide particle | 95 parts |
| Charge control agent (Fe-containing azo dye) | 2 parts |

The above-mentioned compounds were melt-kneaded with a twin-screw extruder heated to 140° C. and the kneaded product was cooled and roughly ground by a hammer mill. The roughly ground product thus obtained was finely pulverized by mechanical pulverization, and the resulting finely pulverized powder was classified by a fixed-wall wind force classifier to produce negatively charging magnetic toner particles having a mass average particle size (D4) of 6.5 μm and an average circularity of 0.958. The above-mentioned mesoporous silica particles A-1, nonporous silica fine particles A-18 and A-19, and nonporous strontium titanate E-3 were externally added and mixed with 100 mass % of the obtained toner particles in the ratios as shown in Table 2 to prepare a developer of Example 1.

TABLE 2

| | Type and Amount of External Additive in Developer | | | | |
|---|---|---|---|---|---|
| | Nonporous external additive (mass %) | | | Porous external additive (mass %) | |
| | A-18 | A-19 | E-3 | Type | Amount |
| Example: 1 | 0.3 | 1.35 | 0.8 | A-1 | 1.5 |
| 2 | ↑ | ↑ | ↑ | A-2 | ↑ |
| 3 | ↑ | ↑ | ↑ | A-3 | ↑ |
| 4 | ↑ | ↑ | ↑ | A-4 | ↑ |
| 5 | ↑ | ↑ | ↑ | A-5 | ↑ |
| 6 | ↑ | ↑ | ↑ | A-6 | ↑ |
| 7 | ↑ | ↑ | ↑ | A-7 | ↑ |
| 8 | ↑ | ↑ | ↑ | A-8 | ↑ |
| 9 | ↑ | ↑ | ↑ | A-9 | ↑ |
| 10 | ↑ | ↑ | ↑ | A-10 | ↑ |
| 11 | ↑ | ↑ | ↑ | A-11 | ↑ |
| 12 | ↑ | ↑ | ↑ | A-12 | ↑ |
| 13 | ↑ | ↑ | ↑ | A-13 | ↑ |
| 14 | ↑ | ↑ | ↑ | A-14 | ↑ |
| 15 | ↑ | ↑ | ↑ | A-15 | ↑ |
| 16 | 0.35 | 1.3 | 0.5 | A-4 | 2.5 |
| 17 | 0.3 | 1.35 | 1.3 | ↑ | 0.5 |
| 18 | 0.3 | 1.35 | 0.8 | B-1 | 1.5 |
| 19 | ↑ | ↑ | ↑ | B-2 | ↑ |
| 20 | ↑ | ↑ | ↑ | B-3 | ↑ |
| 21 | ↑ | ↑ | ↑ | C-1 | ↑ |
| 22 | ↑ | ↑ | ↑ | C-2 | ↑ |
| 23 | ↑ | ↑ | ↑ | C-3 | ↑ |
| 24 | ↑ | ↑ | ↑ | D-1 | ↑ |
| 25 | ↑ | ↑ | ↑ | D-2 | ↑ |
| 26 | ↑ | ↑ | ↑ | E-1 | ↑ |
| 27 | ↑ | ↑ | ↑ | E-2 | ↑ |
| 28 | 0.35 | 1.3 | 0.5 | B-2 | 2.5 |
| 29 | ↑ | ↑ | ↑ | C-2 | ↑ |
| 30 | ↑ | ↑ | ↑ | A-17 | ↑ |
| Comparative example: 1 | 0.35 | 1.3 | 0.5 | A-16 | 2.5 |
| 2 | ↑ | ↑ | ↑ | F-1 | ↑ |

Examples 2 to 30 and Comparative Examples 1 and 2

Developers were prepared in the same manner as that in Example 1 except that the external addition amounts of nonporous silica fine particles A-18 and A-19, and nonporous strontium titanate fine particles E-3 as well as the amount and type of mesoporous external additive in Example 1 were changed as shown in Table 2.

(Evaluation)

The above-mentioned one-component type developers were evaluated for the following evaluation items by the following evaluation methods and the results obtained are shown in Table 3.

<Image Evaluating Device>

The process speed of an LPB printer (LaserJet 4100, manufactured by HP) was changed to be 1.5 times as high as the original one. The condition for primary charging of the electrophotographic photosensitive member were also changed to the condition that in such constant current control as to constantly give a discharge current magnitude of 40 mA, a voltage generated by superimposing an alternating current component: Vpp=2,400 V (maximum wave height of sin wave) on a direct current component: Vdc=−600 V, was applied. In the attached process cartridge, the photographic drum was exchanged for one fabricated according to Electrophotographic photosensitive member example 1, and the developer was replaced by one of the developers of Examples 1 to 30, and Comparative Examples 1 and 2.

<Evaluation Item 1: Accelerated Deterioration Test>

Using the above-mentioned image evaluating device, accelerated toner deterioration tests were performed in an environment of 32.5° C. and 85% RH. 100 g of a toner was placed in a developing device. A urethane blade was brought into contact with a developing sleeve at a linear pressure of 0.37 N/cm (38 g/cm) and an image of solid white was printed on 10,000 sheets. When printing the initial sheet and the 10,000th sheets, an image composed of nine (3 columns by 3 rows) solid black 5 mm squares was printed, and the reflection density of the image was measured using a MCBETH densitometer (manufactured by McBeth) and an SPI filter. The smaller the difference between the obtained values, the toner is stronger against deterioration.

Further, as indices of toner deterioration and toner flowability, degrees of agglomeration of the toner before and after accelerated deterioration durability test were measured using a Powder Tester P-100 (Hosokawa Micron Co.). Specifically, sieves having mesh openings of 250 μm, 150 μm, and 75 μm, respectively, were set in this order from above on a shaking table and 5 g of a toner was gently mounted on the uppermost sieve and shaken at a shaking width of 1 mm for a shaking time of 20 seconds. After the shaking stopped, the mass of the toner that remained on each sieve was measured.

Calculation was performed as follows.

(Amount of toner remaining on the upper sieve)÷5 (g)×100 — a (Amount of toner remaining on the medium sieve)÷5 (g)×100×0.6 — b (Amount of toner remaining on the lower sieve)÷5 (g)×100×0.2 — c $a+b+c$=degree of agglomeration (%)

The smaller the difference in degree of agglomeration between before and after the durability test, the toner is stronger against deterioration, and the smaller the degree of agglomeration, the toner has better flowability.

<Evaluation Item 2: Toner Triboelectric Charge Stability>

Using the above-mentioned evaluating device, tests were performed as follows. A pattern of 4-dot transverse lines printed every 176 dot spaces was printed on 20,000 sheets in a low temperature and low humidity (LL) environment at 10° C. and 10% RH or in a high temperature and high humidity (HH) environment at 32.5° C. and 85% RH.

The image density was determined by measuring an image of a square of 5 mm×5 mm. Evaluation of these was performed at the initial stage and at the 20,000th sheet. The smaller the rate of change in value, the toner has more improved triboelectric charge stability. Also, the smaller the difference in environment, the toner can be said to have higher environment stability. The measurement of the image density was performed using a Model 404 reflection densitometer manufactured by X-Rite Co.

<Evaluation Item 3: Evaluation on Image Deletion>

Image deletion was evaluated as follows. That is, an image having an image area ratio of about 3% was continuously printed out on 10,000 sheets under a high temperature and high humidity environment (32.0° C., 85% RH). Then, once the power of the image evaluating device was switched off and again the image evaluating device was operated 3 days later and a lattice pattern including 4-dot vertical and transverse lines printed every 176 dot spaces was output. Based on the density of printing of each line, the degree of image deletion was determined. In the present evaluation, paper using talc that is empirically known to readily cause image deletion as a loading material (adjusted to 32.5° C., 85% RH, and moisture absorption of 10%) was used as evaluation paper. The moisture absorption amount of paper was measured by using MOISTREX MX5000 manufactured by Infrared Engineering Co. Evaluation was made according to the following standards.

A: No image deletion occurred.

B: Intermediate level between A and C.

C: While image deletion occurred to some extent, choppy lines were half the whole or less.

D: Intermediate level between C and E.

E: Image deletion occurred and area where no lines are present occupies ⅓ or more of the whole image.

<Evaluation Item 4: Evaluation of Toner Fusion>

An image having an image area ratio of about 3% was continuously printed out on 10,000 sheets in a high temperature and high humidity environment (32.5° C., 85% RH), and then a solid black image was formed on the whole A4-size recording paper. A degree of occurrence of white spots on the solid black image was evaluated.

Evaluation was made according to the following standards.

A: No white spots occurred on A4-size recording paper.

B: Intermediate level between A and C.

C: About 10 white spots were observed on A4-size recording paper.

D: Intermediate level between C and E.

E: 100 or more white spots were observed on A4-size recording paper.

This phenomenon is caused by image exposure light shielding due to fusion of the developing agent on the electrophotographic photosensitive member.

TABLE 3

Results of Evaluation on Examples and Comparative Example Developers

| | Evaluation item | | | | | | | | | |
|---|---|---|---|---|---|---|---|---|---|---|
| | 1 | | | | 2 | | | | | |
| | Image density | | Degree of agglomeration of toner (%) | | Trioelectric charge stability (LL) | | Triboelectric charge stability (HH) | | 3 | 4 |
| Contents | Initial | 10,000th sheets | Initial | 10,000th sheets | Initial | 20,000th sheets | Initial | 20,000th sheets | Image deletion | Toner fusion |
| Example: 1 | 1.50 | 1.40 | 20 | 35 | 1.52 | 1.47 | 1.47 | 1.32 | A | A |
| 2 | 1.48 | 1.41 | 25 | 38 | 1.48 | 1.46 | 1.45 | 1.30 | A | A |
| 3 | 1.52 | 1.44 | 18 | 32 | 1.48 | 1.46 | 1.49 | 1.34 | B | A |
| 4 | 1.47 | 1.39 | 22 | 34 | 1.51 | 1.49 | 1.44 | 1.30 | A | A |
| 5 | 1.46 | 1.32 | 35 | 65 | 1.49 | 1.47 | 1.43 | 1.29 | A | B |
| 6 | 1.48 | 1.32 | 20 | 29 | 1.47 | 1.45 | 1.45 | 1.30 | B | A |
| 7 | 1.49 | 1.35 | 21 | 33 | 1.51 | 1.49 | 1.46 | 1.31 | A | A |
| 8 | 1.51 | 1.31 | 25 | 40 | 1.51 | 1.49 | 1.48 | 1.33 | A | A |
| 9 | 1.44 | 1.30 | 24 | 37 | 1.49 | 1.47 | 1.41 | 1.27 | A | A |
| 10 | 1.41 | 1.32 | 25 | 41 | 1.46 | 1.44 | 1.38 | 1.24 | A | A |
| 11 | 1.45 | 1.33 | 28 | 52 | 1.48 | 1.46 | 1.42 | 1.28 | A | A |
| 12 | 1.49 | 1.34 | 34 | 62 | 1.51 | 1.49 | 1.46 | 1.31 | A | A |
| 13 | 1.48 | 1.28 | 20 | 33 | 1.46 | 1.44 | 1.45 | 1.30 | A | A |
| 14 | 1.43 | 1.25 | 19 | 28 | 1.47 | 1.45 | 1.40 | 1.26 | A | A |
| 15 | 1.47 | 1.29 | 17 | 30 | 1.50 | 1.48 | 1.44 | 1.29 | A | A |
| 16 | 1.50 | 1.33 | 22 | 35 | 1.52 | 1.50 | 1.47 | 1.32 | A | A |
| 17 | 1.52 | 1.32 | 24 | 39 | 1.44 | 1.42 | 1.49 | 1.34 | A | A |
| 18 | 1.44 | 1.27 | 12 | 25 | 1.46 | 1.44 | 1.41 | 1.27 | A | A |
| 19 | 1.46 | 1.31 | 14 | 22 | 1.48 | 1.46 | 1.43 | 1.29 | A | A |
| 20 | 1.48 | 1.34 | 15 | 28 | 1.49 | 1.47 | 1.45 | 1.30 | A | A |
| 21 | 1.49 | 1.35 | 22 | 31 | 1.42 | 1.40 | 1.46 | 1.31 | A | A |
| 22 | 1.42 | 1.28 | 24 | 38 | 1.51 | 1.49 | 1.39 | 1.25 | A | A |
| 23 | 1.51 | 1.30 | 18 | 25 | 1.47 | 1.45 | 1.48 | 1.33 | A | A |
| 24 | 1.47 | 1.32 | 14 | 20 | 1.51 | 1.49 | 1.44 | 1.30 | A | A |
| 25 | 1.46 | 1.33 | 22 | 39 | 1.51 | 1.49 | 1.43 | 1.29 | A | A |
| 26 | 1.43 | 1.26 | 17 | 35 | 1.49 | 1.47 | 1.40 | 1.26 | A | A |
| 27 | 1.41 | 1.34 | 22 | 41 | 1.46 | 1.44 | 1.38 | 1.24 | A | A |
| 28 | 1.48 | 1.31 | 27 | 38 | 1.48 | 1.46 | 1.45 | 1.30 | A | A |
| 29 | 1.50 | 1.30 | 25 | 41 | 1.51 | 1.49 | 1.47 | 1.32 | A | A |
| 30 | 1.48 | 1.33 | 31 | 54 | 1.54 | 1.52 | 1.45 | 1.35 | B | A |
| Comparative example: 1 | 1.48 | 1.22 | 32 | 55 | 1.47 | 1.38 | 1.35 | 0.80 | C | C |
| 2 | 1.38 | 1.08 | 30 | 50 | 1.47 | 1.42 | 1.35 | 0.98 | A | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-151777, filed May 31, 2006, which is hereby incorporated by reference herein in its entirety.

What is claimed is:

1. A toner comprising colored particles containing at least a binder resin and a colorant, and two or more external additives, wherein at least one of the external additives is composed of mesoporous particles subjected to hydrophobic treatment with a treating agent containing substituted or unsubstituted amino group, and the mesoporous particles of the external additive have a BET specific surface area of 400 $m^2/g$ or more and 1,000 $m^2/g$ or less, and wherein primary particles of the mesoporous particles of the external additive (a) have an average particle size of 0.2 μm or more and 1.7 μm or less and (b) are inorganic particles of at least one selected from the group consisting of silica, titanium oxide, alumina, cerium oxide, and strontium titanate.

2. An electrophotographic apparatus comprising a developing unit that includes the toner according to claim 1; and a member that is brought into contact with an electrophotographic photosensitive member which removes the toner remaining on the electrophotographic photosensitive member after transferring a toner image to a receiving member.

3. An electrophotographic apparatus according to claim 2, wherein the developing unit is a non-contact developing unit in which the toner in the developing unit is not in contact with the electrophotographic photosensitive member.

4. An electrophotographic process cartridge which comprises a unit having the toner according to claim 1 and at least one unit selected from the group consisting of a charging unit, a unit having an electrophotographic photosensitive member, a transfer unit, a cleaning unit, an auxiliary charging unit and a de-charging unit, and is detachably mountable on an electrophotographic apparatus.

5. An electrophotographic process cartridge detachably mountable on an electrophotographic apparatus, which includes a unit containing the toner of claim 1 and a member that is brought into contact with an electrophotographic photosensitive member to remove toner remaining on the electrophotographic photosensitive member after transferring the toner onto a recording medium, which is provided with at least an electrophotographic photosensitive member the member coming into contact with the electrophotographic photosensitive member to remove remaining toner, and the unit containing the toner.

* * * * *